US011903469B2

(12) United States Patent
De Vos et al.

(10) Patent No.: US 11,903,469 B2
(45) Date of Patent: Feb. 20, 2024

(54) SNAP FIT CONNECTOR FOR USE WITH LUGGAGE ARTICLE COMPONENTS

(71) Applicant: Samsonite IP Holdings S.a.r.l., Luxembourg (LU)

(72) Inventors: Wim De Vos, Zingem (BE); Jean-Claude Van De Walle, Zarlardinge (BE); Clotilde Destrebecq, Anvaing (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 16/682,034

(22) Filed: Nov. 13, 2019

(65) Prior Publication Data

US 2020/0146411 A1 May 14, 2020

(30) Foreign Application Priority Data

Nov. 13, 2018 (EP) ..... 18206081

(51) Int. Cl.
*A45C 13/10* (2006.01)
*A45C 5/14* (2006.01)

(52) U.S. Cl.
CPC ..... *A45C 13/1092* (2013.01); *A45C 5/14* (2013.01)

(58) Field of Classification Search
CPC ..... A45C 13/1092; A45C 13/262; A45C 5/14; A45C 5/143
See application file for complete search history.

(56) References Cited

U.S. PATENT DOCUMENTS 4,422,212 A * 12/1983 Sheiman ..... A45C 5/143 280/37
6,032,771 A * 3/2000 Pedrini ..... A45C 5/14 190/115
6,604,616 B2 * 8/2003 Cheng ..... A45C 5/02 190/122
6,827,186 B1 * 12/2004 Hsie ..... A45C 13/262 16/113.1
7,506,736 B1 3/2009 Chen
9,872,547 B2 * 1/2018 Naiva ..... B25H 3/02
(Continued)

FOREIGN PATENT DOCUMENTS

CN 2231211 Y 7/1996
CN 105962597 A 9/2016

OTHER PUBLICATIONS

Extended European Search Report of European patent application No. 18206081.4, dated May 3, 2019, 7 pages.

*Primary Examiner* — David M Upchurch
(74) *Attorney, Agent, or Firm* — Dorsey & Whitney LLP

(57) ABSTRACT

A snap fit interlock for attaching a component of a luggage article may include a snap fitting connecting a luggage article component to a luggage shell, and a locking feature automatically limiting the disengagement of the snap fitting once the snap fitting is engaged. The snap fitting may engage and move the locking feature as the snap fitting is moved in an insertion direction during attachment of the luggage article component to the luggage shell. The locking feature may disengage from the snap fitting when the snap fitting engages the luggage shell. A portion of the locking feature may be automatically positioned between the snap fitting and the luggage article component to limit disconnection of the snap fitting once engaged.

15 Claims, 13 Drawing Sheets

(56) References Cited

U.S. PATENT DOCUMENTS

| | | | | |
|---|---|---|---|---|
| 2006/0186642 | A1* | 8/2006 | Kady | A01K 97/06<br>280/652 |
| 2012/0272434 | A1 | 11/2012 | VanNostran | |
| 2015/0014108 | A1* | 1/2015 | Vecellio | A45C 13/02<br>190/100 |

* cited by examiner

SNAP FIT CONNECTOR FOR USE WITH LUGGAGE ARTICLE COMPONENTS

CROSS-REFERENCE TO RELATED APPLICATION

This application claims priority to European Patent Application No. 18206081.4, filed Nov. 13, 2018 and entitled "Snap Fit Connector For Use With Luggage Article Components", which is hereby incorporated by reference herein in its entirety for all purposes.

TECHNICAL FIELD

The present disclosure relates generally to luggage articles, and more specifically to snap fit connectors for connecting components of a luggage article to a luggage housing.

BACKGROUND

Some luggage cases include components secured together by screws or fastener fixation. In addition or as an alternative, some luggage cases include components connected together by snap fit connectors. Without backing up the snap fit connectors with screws or fasteners, traditional snap fit connections can become loose over time during handling and impact.

It is therefore desirable to provide an improved luggage case, and more specifically an improved snap fit connector or interlock that addresses one or all of the above-described problems and/or which more generally offers improvements or an alternative to existing arrangements.

Documents that may be related to the present disclosure include CN2231211Y, CN202874165U, CN203318036U, CN204020414U, CN206482158U, CN207506100U, U.S. Pat. Nos. 4,422,212A, 7,337,495B2, and US20020003375A1.

SUMMARY

The present disclosure provides a snap fit interlock for connecting components of a luggage article to a luggage housing. The snap fit interlock includes a snap fitting and a locking feature that secures the snap fitting once engaged. During assembly, a portion of the snap fitting may bias the locking feature to a displaced or compressed configuration. Once the snap fitting is fully seated in position, engaged, actuated, or connected, the snap fitting disengages the locking feature to allow movement of the locking feature to its neutral or uncompressed configuration. Once the snap fitting is fully engaged or connected, and the locking feature moves to its neutral configuration, disengagement of the snap fitting is limited through interference by the locking feature. For example, the locking feature may engage the snap fitting by itself to resist displacement of the snap fitting; or in another example the locking feature may engage the snap feature and another component or portion of the luggage article to create a solid or substantially solid stack or column to limit deflection of the snap fitting. The other component may be the luggage case or a component separate from the luggage case, such as a tow handle tube.

According to a first aspect of the present disclosure, there is provided a snap fit interlock for attaching a component to a luggage article. The snap fit interlock may include a snap fitting connecting a luggage article component to a luggage shell, and a locking feature automatically limiting the disengagement of the snap fitting once the snap fitting is engaged.

Optionally, the locking feature may limit movement of at least a portion of the snap fitting to limit disengagement of the snap fitting. The snap fitting may engage and move the locking feature as the snap fitting is moved in an insertion direction during attachment of the luggage article component to the luggage shell. The snap fitting may move the locking feature from a neutral position to a displaced position. The snap fitting may define a first and a second position as the snap fitting is moved in an insertion direction. The snap fitting may engage and move the locking feature only when the snap fitting is in the second position. The locking feature may disengage from the snap fitting when the snap fitting moves to the first position. The first and second positions of the snap fitting may be defined at respective levels of displacement. The luggage shell may include a ramp to displace the snap fitting from the first level to the second level. The snap fitting may engage and move the locking feature only when the snap fitting is at the second level.

Optionally, the locking feature may include a portion positioned between the snap fitting and the luggage article component to limit disconnection of the snap fitting. The locking feature may create a stacked arrangement between the luggage article component, locking feature, and snap fitting to limit disengagement of the snap fitting.

Optionally, the locking feature may allow movement of at least a portion of the snap fitting a first distance less than the distance required to disengage the snap fitting from the luggage shell.

Optionally, the locking feature may include a portion that resists disengagement of the snap fitting in a direction along its length.

Optionally, the locking feature may include a loop structure deflecting at least partially in its plane during engagement of the snap fitting to the luggage shell. The loop structure may resist disengagement of the snap fitting in a direction other than in the plane defined by the loop structure. The locking feature may include at least one wing extending from a lateral side of the snap fitting. The at least one wing may engage a lateral edge of an aperture defined in the luggage shell to limit removal of the snap fitting from the aperture once the snap fitting is engaged. The locking feature may include a protrusion that deflects along its length during engagement of the snap fitting to the luggage shell.

Optionally, the snap fitting may include a catch having a resilient main body and an arm connected to a distal end of the main body. The main body and arm may define an L-shape.

Optionally, the snap fitting may connect a tow handle, a carry handle, or a wheel housing to the luggage shell.

Optionally, the locking feature may be defined by a part of the luggage shell.

Optionally, the snap fitting may be positioned at least partially within an aperture defined in the luggage shell to connect the luggage article component to the luggage shell. The locking feature may limit removal of the snap fitting from the aperture once the snap fitting is connected.

Optionally, the locking feature may include a flexible first portion connected to the luggage shell, and a second portion connected to the first portion. The second portion may resist disengagement of the snap fitting in a direction along its length.

According to a second aspect of the present disclosure, there is provided a snap fit interlock for a luggage article. The snap fit interlock may include a first snap fitting connecting first and second components of a luggage article together when the first snap fitting is positioned in an engaged configuration. In particular, the first snap fitting may connect a luggage article component, for example such as a tow handle, carry handle, or wheel housing, to a luggage case or to another component. The snap fit interlock may include a second snap fitting that engages or connects to the first snap fitting. The second snap fitting (also referred to as an example of a lock feature) may limit disengagement of the first snap fitting from the engaged configuration.

Optionally, the second snap fitting may be positioned against one of the first and second components to limit disengagement of the first snap fitting from the engaged configuration. The second snap fitting may be positioned at least partially between the first snap fitting and the first component of the luggage article to limit movement of the first snap fitting towards the first component. The second snap fitting may engage the first snap fitting and the first component to limit disengagement of the first snap fitting from the engaged configuration.

Optionally, the first snap fitting may be connected to, defined by, or integral with the first component. The second snap fitting may be connected to, defined by, or integral with the second component. Alternatively, the second snap fitting may be connected to, defined by, or integral with the first component.

Optionally, the first snap fitting may include a catch member having a resilient main body and an arm connected to a distal end of the main body, the catch member movable between first and second positions The main body may include opposing first and second surfaces. The arm may include an abutment face and a first surface. The second component may include a base wall with a ramp terminating at an edge. When the first snap fitting is in the engaged configuration, at least portions of the arm and first surface of the main body engage the base wall, and the second snap fitting engages the second surface of the main body to limit movement of the catch away from the base wall. The first surface of the catch may engage the ramp of the second component to move the main body from the first position to the second position. The abutment face of the catch may engage the second snap fitting when the main body is in the second position. The catch may then move further in an insertion direction to move the second snap fitting until the first snap fitting moves past or disengages the ramp. The main body of the catch may be biased from the second position to the first position once the arm of the catch disengages the ramp of the base wall to move the first snap feature to the engaged configuration. Movement of the main body from the second position to the first position may disengage the abutment face of the catch from the second snap fitting to allow movement of the second snap fitting to a position limiting disengagement of the first snap fitting from the engage configuration.

Optionally, the second snap fitting may move between neutral and displaced positions. The second snap fitting may be biased to the neutral position. Movement of the second snap fitting to the displaced position may allow movement of the first snap fitting to the engaged configuration. The second snap fitting may automatically move to the neutral position when the first snap fitting moves to the engaged configuration to limit disengagement of the first snap fitting from the engaged configuration.

Optionally, the second snap fitting may include an arm or loop. The loop may be an elongated rim. The loop may be continuous or discontinuous along its length.

Optionally, the second snap fitting may include one or more wings extending from the first snap fitting.

Optionally, the first component may be a tow handle tube, a carry handle, or a wheel housing. The second component may be a luggage shell.

According to a third aspect of the present disclosure, there is provided a method of attaching a luggage article component to a luggage shell. The method may include attaching a snap fitting of the luggage article component to the luggage shell, and positioning a locking feature against a portion of the snap fitting to limit the snap fitting from disconnecting once the snap fitting is connected.

Optionally, the method may include moving the locking feature to a compressed position to allow the snap fitting to lock against a portion of the luggage shell. The locking feature may be moved to the compressed position through movement of the snap fitting in an insertion direction during attachment of the snap fitting to the luggage shell. attaching the snap fitting to the luggage shell may include sliding a catch against a portion of the luggage shell until the catch engages a locking edge of the luggage shell. Sliding the catch against a portion of the luggage shell may include moving the catch from a first position to a second position. Continued sliding of the catch in the insertion direction while the catch is in the second position may cause the catch to engage the locking feature to move the locking feature to the compressed position. Engagement of the catch with the luggage shell may release the locking feature from the compressed position and allow the locking feature to be positioned against the snap fitting to limit disconnection of the snap fitting once engaged.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

According to the present disclosure, snap fit connectors are provided for coupling various components to the housing or shell of a luggage article. The snap fit connectors may be integrated as part of the components and housing of the luggage article. The snap fit connectors may interface with each other once engaged to define a snap fit interlock. Once interlocked together, the snap fit connectors may be limited from disengagement.

Figure 1:
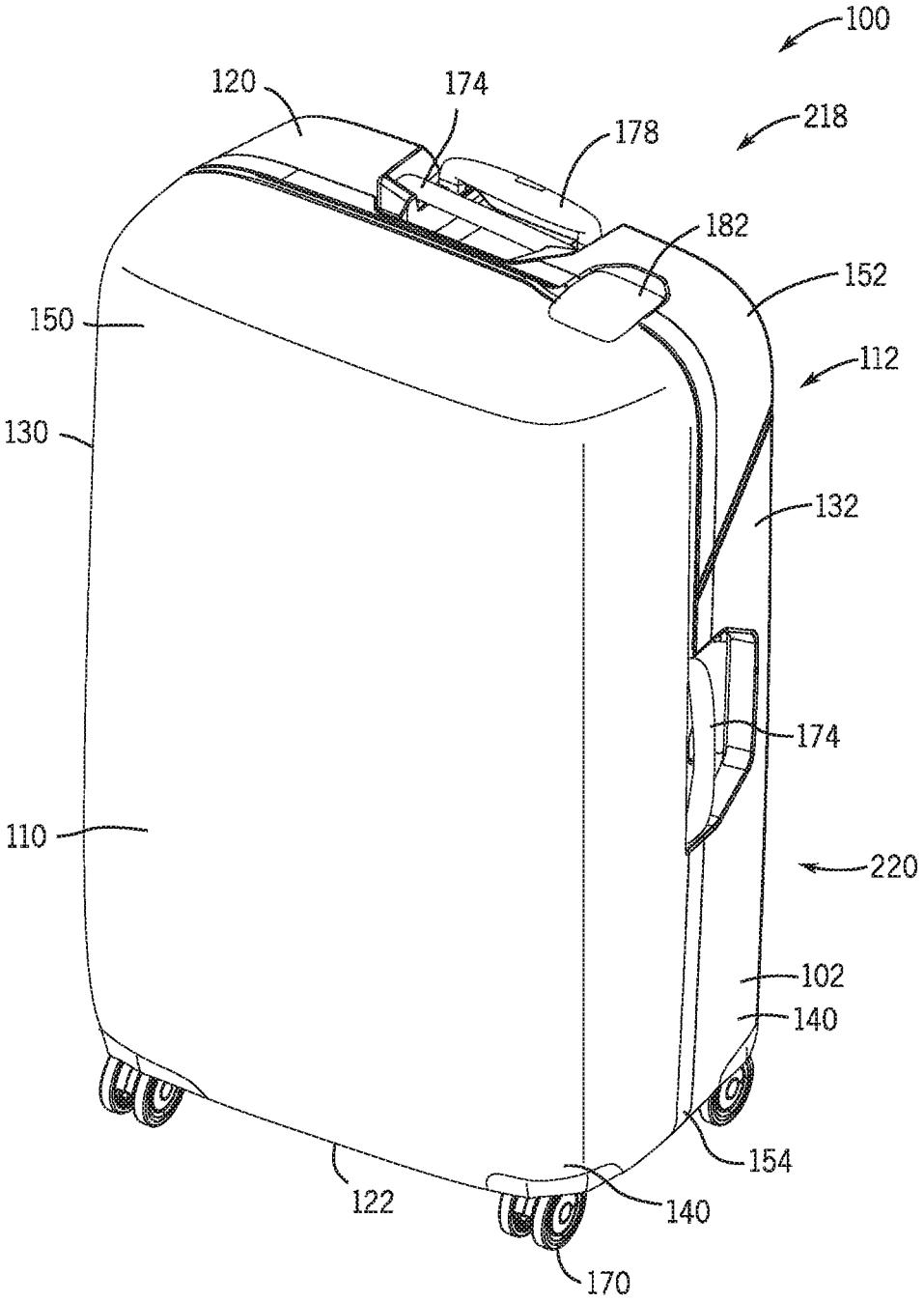
FIG. 1 is a front isometric view of a luggage article according to some examples of the present disclosure.
Figure 2:
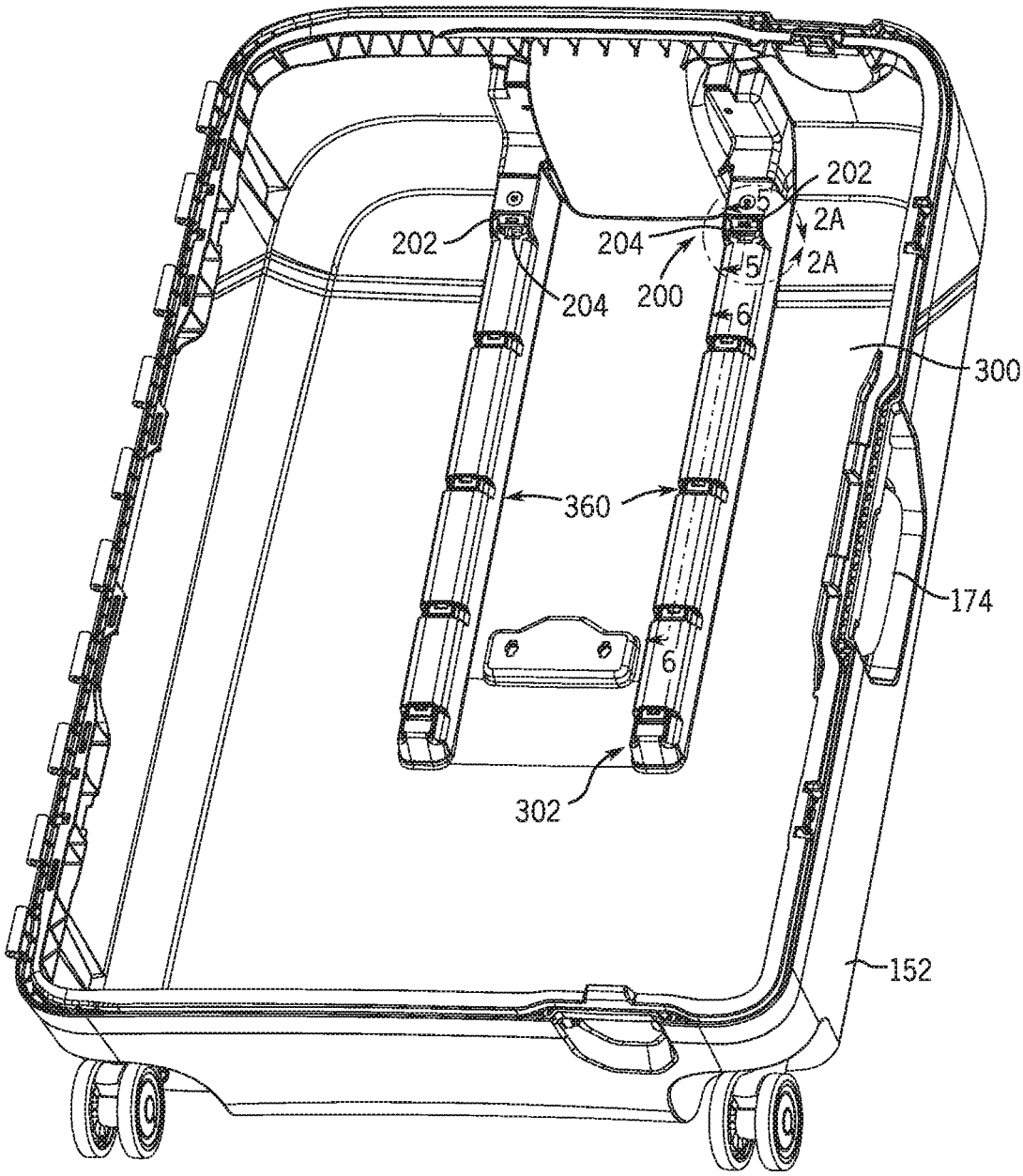
FIG. 2 is an isometric view of a luggage shell portion according to some examples of the present disclosure.
Figure 2A:
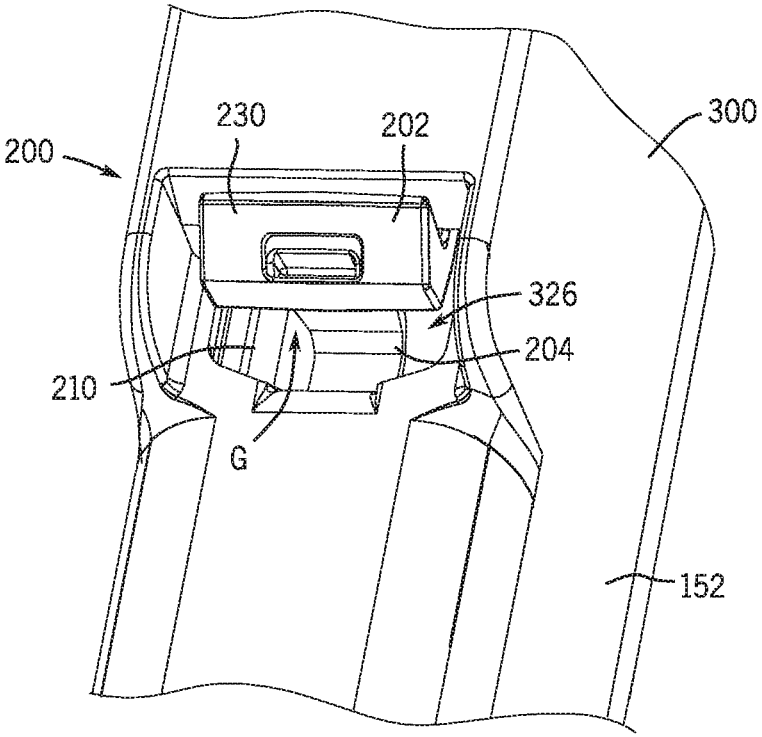
FIG. 2A is an enlarged detail view of a snap fit interlock according to some examples of the present disclosure.
Figure 2B:
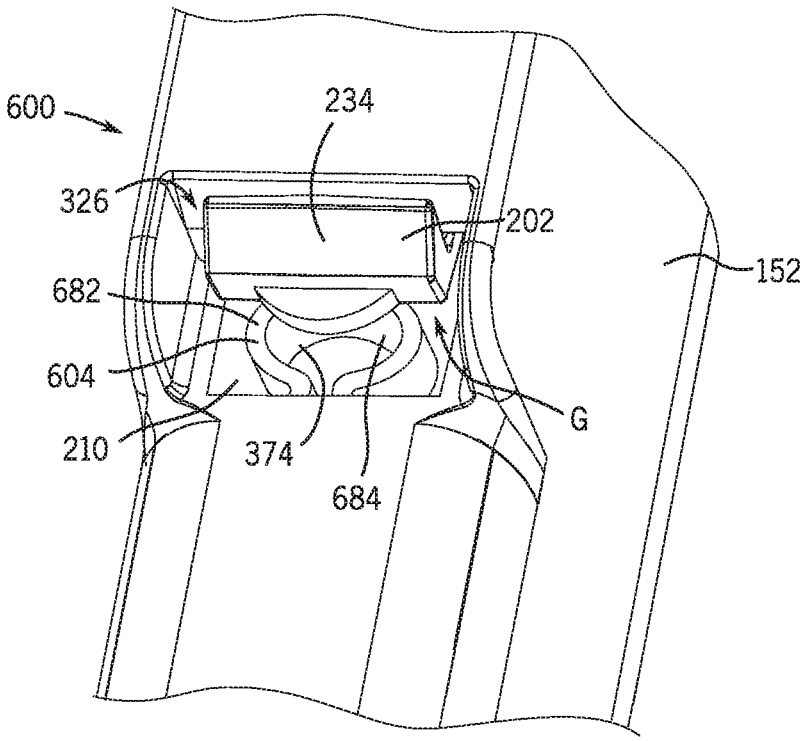
FIG. 2B is an enlarged detail view of an additional snap fit interlock according to some examples of the present disclosure.

FIG. 1 illustrates an exemplary luggage article 100 according to some examples of the present disclosure. The luggage article 100 includes a housing 102 formed from a plurality of walls or panels (hereinafter "panels" for the sake of convenience without intent to limit) defining an internal storage volume in which to carry a user's belongings. In one example, the housing 102, may be formed from opposing front and rear panels 110, 112 and a plurality of side panels extending between the front and rear panels 110, 112. For instance, the luggage article 100 may include opposing top and bottom panels 120, 122 and opposing left and right side panels 130, 132 extending between the front and rear panels 110, 112. Corner regions 140 may be defined by the intersection of any two or three adjacent panels. For example, corners formed by the intersection of any three adjacent panels may be considered a "corner region." Edges formed by the intersection of any two adjacent panels may also be considered a "corner region" or "edge region."

The various panels may be configured or arranged to provide a desired size and shape of the housing 102. As shown in FIG. 1, the various panels may be sized and shaped to provide a height H, width W, and depth D of the housing 102. The height H of the housing 102 may be defined as the distance between the top and bottom panels 120, 122. The width W of the housing 102 may be defined as the distance between the left and right side panels 130, 132. Similarly, the depth D of the housing 102 may be defined as the distance between the front and rear panels 110, 112. The panels may be sized and shaped such that the luggage article 100 is taller than it is wide and wider than it is deep, such as that shown in at least FIG. 1. Other sizes and shapes of the housing 102 are contemplated, and the examples shown and described are for illustration purposes only.

The luggage article 100 illustrated in FIG. 1 is an upright spinner hard side case but may be many types of luggage, including a soft side spinner case, a container, or the like. As shown, the luggage article 100 includes a first shell 150 and a second shell 152 defined by a split line 154. The first and second shells 150, 152, which may be front and rear shell portions, respectively, may be sized similarly to each other, or one of the shell portions may be sized to include a larger or smaller internal volume. The luggage article 100 may be moved between a closed configuration and an open configuration. In the closed configuration, the first and second shells 150, 152 may be positioned adjacent to each other, and in one example with respective rims of the shell portions in engagement, to enclose a user's belongings within the internal storage volume of the luggage article 100. In the open configuration, the first and second shells 150, 152 may be re-oriented relative to each other, such as in one example towards and away from each other, to allow user access to the interior of the luggage article 100.

To allow selective movement of the first and second shells 150, 152 between the open and closed configurations, the first and second shells 150, 152 may be pivotably attached together by a hinge or similar mechanism arranged to allow selective positioning, such as in one example by rotation about an axis of the hinge, of the first shell 150 relative to the second shell portion 152 from fully closed to fully open. The hinge may include many configurations. For example, the hinge may include any number or combination of a fabric strip, a strip of rubber, a piano hinge, a living hinge, spaced-apart discrete hinges, a zipper structure, an articulating joint made of elastomeric material, or other suitable structures that allow relative movement between the first and second shells 150, 152.

The luggage article 100 is illustrated as a hard side luggage case, but may be formed from many combinations of hard side and soft side material. For example, the housing 102 may be molded from hard side material, or formed from a combination of hard side material and soft side material (known as "hybrid" construction). In some examples, the housing 102 may be formed entirely from soft side material supported by a frame structure suitably configured to allow for the snap fit connections as described herein. In such examples, the housing 102 may include portions designed to allow a snap fit connection thereto. For instance, the housing 102 may include hard plastic inserts at the locations where a snap fit connection is to be used. The hard side material may be a thermoplastic material (self-reinforced or fiber-reinforced), ABS, polycarbonate, polypropylene, polystyrene, PVC, polyamide, PTFE, or biaxially oriented polypropylene, among others. The soft side material may be nylon, canvas, polyester, leather, PVC, polypropylene, polyethylene, and/or PTFE, among others.

With continued reference to FIG. 1, the luggage article 100 may include other features for convenience. For example, the luggage article 100 may include one or more support members 170 to support the luggage article 100 against a support surface (e.g., against the ground). The support members 170, which may be a foot, a fixed wheel assembly, a spinner wheel assembly, or any combination thereof, may be associated with any suitable panel of the housing 102, such as in at least one example connected to at least the bottom panel 122. As shown, the luggage article 100 may include four support members 170. In such examples, the luggage article 100 may include two support members 170 connected to each of the first shell 150 and the second shell 152. The support members 170 may be connected to any suitable portion of the housing 102, such as at or near the corner regions 140 along the bottom panel 122 in the manner as described below.

The luggage article 100 may include one or more carry handles 174 connected to at least one of the panels of the housing 102. Additionally or alternatively, the luggage article 100 may include a retractable tow handle 178 connected to at least the rear panel 106 of the housing 102. In some examples, the luggage article 100 may include a closure mechanism 182 to selectively secure the first shell 150 and the second shell portion 152 together. The closure mechanism 182 may be positioned along or adjacent to the split line 154 between the first shell 150 and the second shell portion 152 to engage each of the shell 150, 152 and allow selective actuation for opening and closing of the luggage article 100. The closure mechanism 182 may be a discrete mechanism, such as a latch or clamp positioned at discrete positions along the split line 154, or may be a continuous-closure mechanism positioned along at least a part of the length of the split line 154, such as a zipper closure.

As described herein, the luggage article 100 may include snap fit connectors for connecting various components of the luggage article 100 to the housing 102. For instance, one or more snap fit connectors may be used to attach one or more components to one or both of the first and second shells 150, 152. As described more fully below, the snap fit connectors may attach the tow handle 178, carry handles 174, and/or support members 170 to the housing 102, though the snap fit connectors described herein may be used to connect other luggage article components to the luggage case or to each other. For the sake of simplicity, FIGS. 2-18 illustrate snap fit connectors connecting a plurality of components to the second shell 152. It is contemplated that various components may also or alternatively be connected to the first shell 150 by one or more snap fit connectors. For ease of reference, however, the description below will describe the snap fit connectors of the second shell 152. Except as otherwise noted, components may be connected to the first shell 150 in a similar manner.

Two or more snap fit connectors may be combined, whether integrally on one piece or separately, to define a snap fit interlock 200. More particularly, a first snap fitting 202 may be secured by a locking feature 204 that limits the first snap fitting 202 from disconnecting. Additionally or alternatively, the locking feature 204 may provide a backup in case the first snap fitting 202 becomes disconnected or fails. As described more fully below, the first snap fitting 202 may connect a luggage article component to a luggage shell, such as connecting a tow handle tube 210, a carry handle 174, or a wheel housing to the second shell 152. In such examples, the locking feature 204 may limit the first snap fitting 202 from disconnecting once the first snap fitting 202 is engaged or actuated. In particular, the first snap fitting 202 may include one or more portions that move from a first position to a second position when fully engaged to primarily connect a luggage article component to the luggage case. In such examples, the locking feature 204 may engage or connect to a portion of the first snap fitting 202 to limit disengagement of the first snap fitting 202. In this manner, the first snap fitting 202 and the locking feature 204 may combine to define the snap fit interlock 200. Depending on the particular application, the locking feature 204 may be a second snap fitting, as described more fully below.

Figure 5:
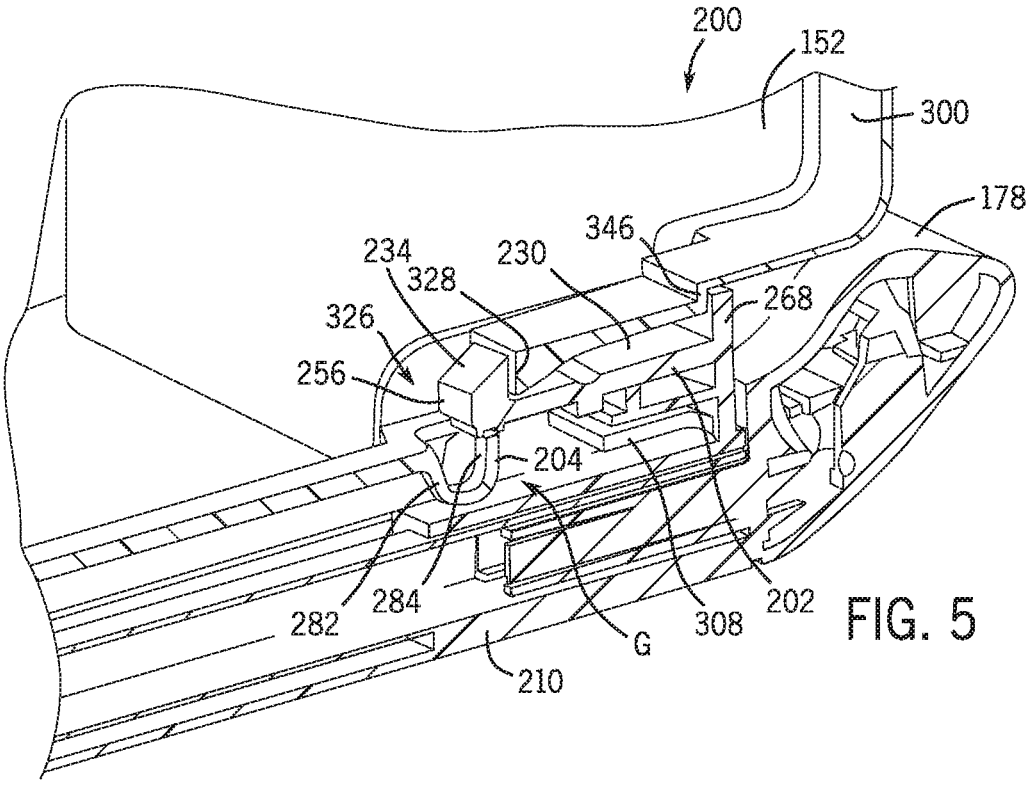
FIG. 5 is a cross-sectional view of the snap fit interlock of FIG. 2A in a third, engaged configuration according to some examples of the present disclosure.

The first snap fitting 202 may include many configurations allowing the first snap fitting 202 to connect first and second components 218, 220 of the luggage article 100 together when the first snap fitting 202 is positioned in an engaged configuration (see FIG. 5). The first and second components 218, 220 may include many elements of the luggage article 100. For instance, the first component 218 may be the tow handle 178, the carry handle 174, or a wheel housing of support member 170, among others. The second component 220 may be a luggage shell, such as the second shell 152. The first and second components 218, 220 may be different elements of the same luggage part. For instance, and without intent to limit, the first and second components 218, 220 may be different elements of the support member 170 that when combined defined the support member 170 itself. In this manner, the first snap fitting 202 may connect the first component 218 (e.g., the tow handle 178, carry handle 174, or support member 170) to a luggage case (e.g., the second shell 152) or to another component.

Figure 3:
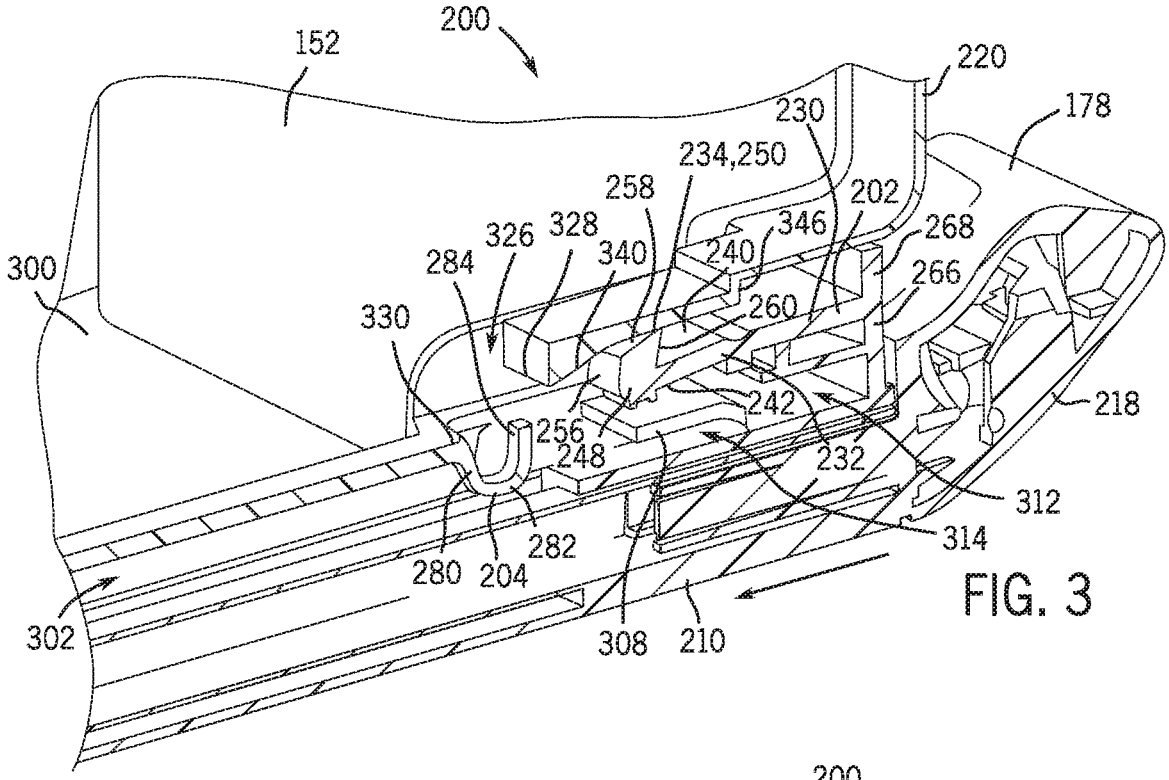
FIG. 3 is a cross-sectional view of the snap fit interlock of FIG. 2A in a first configuration according to some examples of the present disclosure.
Figure 4:
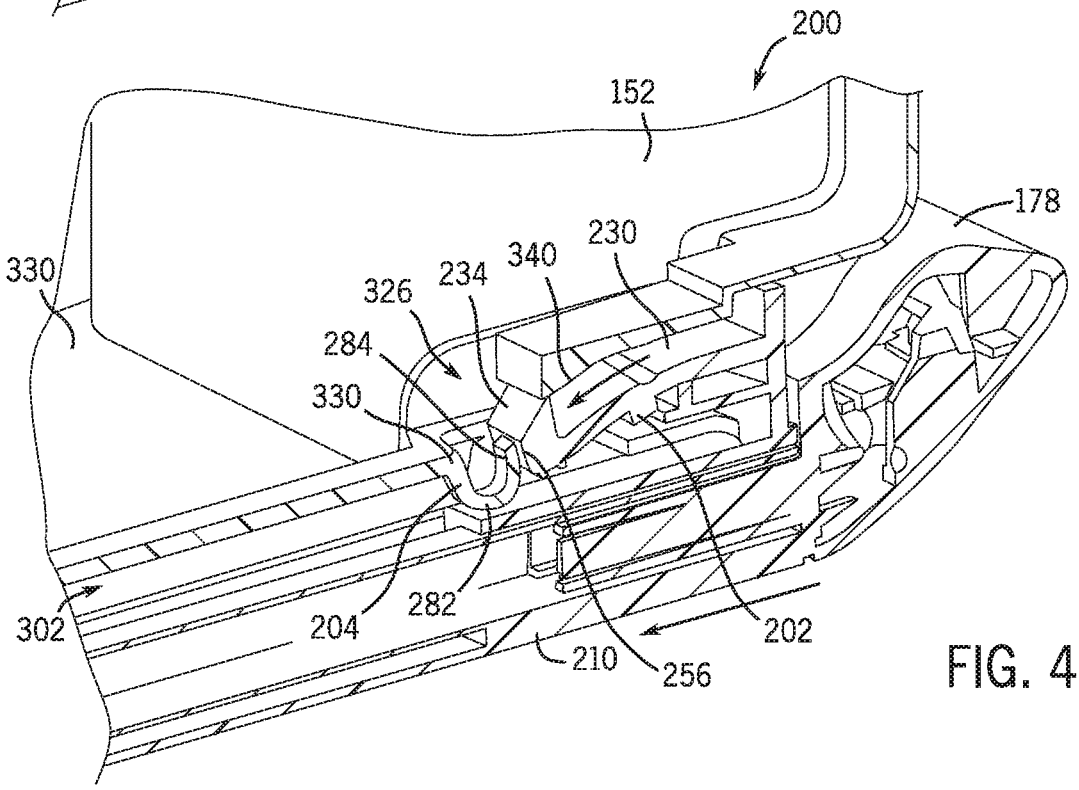
FIG. 4 is a cross-sectional view of the snap fit interlock of FIG. 2A in a second configuration according to some examples of the present disclosure.

As illustrated in FIGS. 3-5, the first snap fitting 202 may be formed as or include a catch member 230. In such examples, the catch member 230 may include a main body 232 and an arm 234 connected to a distal end of the main body 232. The main body 232 includes opposing first and second surfaces 240, 242, which may be top and bottom surfaces, respectively, as oriented in FIGS. 3-5. The arm 234 may include a first portion 248 connected to the distal end of the main body 232, and a second portion 250 extending from the first portion 248, such as away from the first surface 240 of the main body 232. The first portion 248 of the arm 234 may define an abutment face 256 on an axial end of the catch member 230. The second portion 250 of the arm 234 may be defined by opposing first and second surfaces 258, 260. The first surface 258, which may be referred to as a cam or angled surface, may extend from the abutment face 256, such as at an angle relative to the abutment face 256. In such examples, the first and second surfaces 258, 260 may taper towards each other with distance away from the first portion 248 of the arm 234 to define a terminal edge. In this manner, the second portion 250 of the arm 234 may be pointed or define a wedge-like shape in cross-section. As shown, a proximal end of the main body 232 may be connected to a base component or wall 266. In such examples, the main body 232 may be cantilevered from the base component 266.

To allow engagement of the first snap fitting 202, the main body 232 may be resilient to allow movement of the main body 232 between first and second positions. The first position may be referred to as a neutral position and is generally the natural position of the main body 232 when not subjected to external forces. The second position may be referred to as a displaced or deflected position and is generally the position of the main body 232 when subjected to an external force to connect the first snap fitting 202, such as the main body 232 being depressed. Once the external connection force is removed, the main body 232 may be biased to return to the first position. For instance, the material properties and/or configuration of the main body 232 may define a flat spring such that the main body 232 when displaced or deflected springs back to the first position once the external connection force is removed.

Depending on the particular application, the first snap fitting 202 may be connected to or defined by the first component 218. For instance, as shown in FIGS. 3-6, the first snap fitting 202 may be connected to a tow handle tube 210 of the tow handle 178, such as to a proximal end of the tow handle tube 210. In such examples, at least a portion of the first snap fitting 202 may be spaced away from the tow handle tube 210. For instance, a gap G may be defined between the tow handle tube 210 and the catch member 230 of the first snap fitting 202. In such examples, the base component 266 may be connected to the tow handle tube 210 to space the catch member 230 away from the tow handle tube 210 and create the gap G. The base component 266 may also extend beyond the connection with the main body 232 to define an abutment wall 268. As explained in more detail below, the abutment wall 268 may define a fully seated, engaged, or connected position of the first snap fitting 202. For instance, the first snap fitting 202 may not be connected to the second component 220 until the abutment wall 268 engages a portion of the second component 220 to define the engaged configuration of the first snap fitting 202.

With continued reference to FIGS. 3-5, the locking feature 204 will now be discussed in detail. As shown, the locking feature 204 may be positioned against one of the first and second components 218, 220 to limit disengagement of the first snap fitting 202 from the engaged configuration. In one example, the locking feature 204 may be positioned at least partially between the first snap fitting 202 and a component of the luggage article 100 to limit movement of the first snap fitting 202 once engaged. More particularly, the locking feature 204 may be positioned at least partially between the first snap fitting 202 and a component of the luggage article 100 to limit movement of the first snap fitting 202 towards the luggage article component. In one example, the locking feature 204 may be positioned at least partially between the first snap fitting 202 and the component the first snap fitting 202 is connecting to the luggage article 100. In this manner, disengagement of the first snap fitting 202 from the engaged configuration may be limited by abutment of the locking feature 204 with both the first snap fitting 202 and the component the first snap fitting 202 is connecting to the luggage article 100.

Continuing to refer to FIGS. 3-5, the locking feature 204 may be connected to or defined by the second component 220 of the luggage article 100. For instance, the locking feature 204 may be connected to or defined by the second shell 152. In such examples, the first snap fitting 202 may be connected to or defined by the tow handle 178. As explained more fully below, the locking feature 204 may engage both the first snap fitting 202 and a portion of the tow handle 178 to limit disengagement of the first snap fitting 202 once engaged to the second shell 152. For instance, as shown in FIG. 5, the locking feature 204 may create a stacked arrangement between the first snap fitting 202, the locking feature 204, and the tow handle 178 to limit disengagement of the snap fitting.

The locking feature 204 may include many configurations to limit disengagement of the first snap fitting 202 from the engaged configuration. For instance, the locking feature 204 may be formed as or include a second snap fitting. As shown in FIGS. 3-5, the locking feature 204 may include an arm 280. The arm 280 may include a first portion 282 connected to the second shell 152, and a second portion 284 extending from the first portion 282. In such examples, the first portion 282 may space the second portion 284 away from the connection of the first portion 282 with the second shell 152.

The arm 280 may resiliently deform as the first snap fitting 202 is connected. For instance, the locking feature 204 may be moved between neutral and displaced positions to allow engagement of the first snap fitting 202. More particularly, the first portion 282 of the arm 280 may be shaped or otherwise configured to allow compression of the arm 280 through movement of the first snap fitting 202 in an insertion direction during engagement. As one example, the first portion 282 of the arm 280 may be curved to allow resilient movement of the second portion 284 in the insertion direction to allow movement of the first snap fitting 202 to the engaged configuration. Other configurations are contemplated, including configurations where the locking feature 204 includes a spring or other shapes. As described herein, the locking feature 204 may be biased to the neutral position. In such examples, the locking feature 204 may automatically bias from the displaced position to the neutral position absent an external force compressing the feature. For instance, as explained in detail below, once the first snap fitting 202 is connected to the second shell 152, the locking feature 204 may move automatically to the neutral position to limit subsequent disengagement of the first snap fitting 202, such as for example by contacting the snap fitting 202.

The second portion 284 of the arm 280, which may be referred to as a post, may be arranged to limit disengagement of the catch member 230 from the engaged configuration. For instance, the second portion 284 may limit disengagement of the first snap fitting 202 in a direction along its length. The second portion 284 of the arm 280 may be positioned within the gap G defined between the tow handle tube 210 and the catch member 230 of the first snap fitting 202. In such examples, the second portion 284 of the arm 280 may engage the second surface 242 of the catch member 230 to limit movement of the catch member 230 to its second, displaced position. Depending on the particular application, the second portion 284 of the arm 280 may extend perpendicular or substantially perpendicular to the main body 232 of the catch member 230 and engage the tow handle tube 210. In such examples, the second portion 284 of the arm 280 may engage the catch member 230 and the tow handle tube 210 to form a solid or substantially solid stack, strut, or column to limit further deflection. In alternative examples, the locking feature 204, such as the second portion 284, may resist movement of the catch member 230 without contacting the tow handle tube 210, such as for example through the connection details between the locking feature 204 and the second shell 152. Depending on the particular application, the second portion 284 of the arm 280 may still allow small movement of the catch member 230, but not so much as to allow removal of the catch member 230 once engaged. More particularly, the locking feature 204 may allow movement of the first snap fitting 202 a distance less than the distance required to disengage the first snap fitting 202. In this manner, the catch member 230 may not be moved to the displaced position without removal of the second portion 284 of the arm 280 from the gap G.

Referring to FIGS. 2-5, the second shell 152 may include many configurations allowing use of the snap fit interlock 200. For instance, the second shell 152 may include a base wall 300 and one or more channels 302 defined in the base wall 300 to receive one or more tow handle tubes 210 of the tow handle 178. Adjacent to the top panel 120 of the housing 102, the second shell 152 may include a partition wall 308 dividing the channel 302 into first and second channel portions 312, 314. In such examples, the first snap fitting 202 may be received at least partially in the first channel portion 312, and the tow handle tube 210 may be received at least partially in the second channel portion 314 to connect the tow handle 178 to the second shell 152.

The first channel portion 312 may be defined at least partially by a portion of the base wall 300. The portion of the base wall 300 defining the first channel portion 312 may include an aperture 326 defined there through and in communication with the first channel portion 312. In such examples, the aperture 326 may be defined at least in part by first and second edges 328, 330. Depending on the particular application, the first and second edges 328, 330 may be defined at different levels, such as at different spacing from the tow handle 178. As described more fully below, the first snap fitting 202 may be positioned at least partially within the aperture 326 to connect the tow handle 178 to the second shell 152, with the locking feature 204 limiting removal of the first snap fitting 202 from the aperture 326 once the snap fitting is connected. As shown in FIG. 3-5, a ramp 340 may be defined in the base wall 300 adjacent to the first edge 328 to facilitate connection of the snap fit interlock 200, as explained below. For instance, the ramp 340 may be shaped and positioned such that the catch member 230 is displaced sufficiently to vertically clear the first edge 328 of the aperture 326 as well as displaced laterally beyond the first edge 328 such that when released of disengaged, the catch member 230 may engage a portion of the base wall 300. The locking feature 204 may be connected to the second edge 330. The portion of the base wall 300 defining the first channel portion 312 may define an engagement structure 346. The abutment wall 268 of the first snap fitting 202 may engage, such as contact, the engagement structure 346 of the second shell 152 to define a fully seated position of the first snap fitting 202.

Engagement of the snap fit interlock 200 will now be discussed in more detail with reference to FIGS. 3-5. Referring to FIG. 3, the tow handle 178 may be positioned adjacent to the second shell 152 such that the catch member 230 of the first snap fitting 202 is positioned partly within the first channel portion 312 and the tow handle tube 210 is positioned within the second channel portion 314. In the arrangement shown in FIG. 3, the catch member 230 is in the first, neutral position, with the main body 232 and arm 234 positioned between the partition wall 308 and base wall 300 of the second shell 152.

Once positioned as shown in FIG. 3, the first snap fitting 202 may be connected to the second shell 152 through movement of the first snap fitting 202 in an insertion direction. For instance, the tow handle 178 may be moved toward the bottom panel 122 of the housing 102 to move the catch member 230 towards locking feature 204. As the first snap fitting 202 is moved in the insertion direction, the ramp 340 defined on the base wall 300 may cause the catch member 230 to deflect to its second, displaced position. For instance, as shown in FIG. 4, the ramp 340 may cause deflection of the catch member 230 towards the tow handle tube 210 as the catch member 230 is moved in the insertion direction. The catch member 230 may be deflected towards the tow handle tube 210 as the first surface 258 of the arm 234 slidably engages the ramp 340. In this manner, the first and second positions of the catch member 230 may be defined at different levels of displacement. As explained below, the catch member 230 may engage the locking feature 204 only when positioned at the second level of displacement. In such examples, movement of the catch member 230 to the first level of displacement may disengage the locking feature 204 from the first snap fitting 202.

With continued reference to FIG. 4, deflection of the catch member 230 towards the tow handle tube 210 may position the abutment face 256 on the axial end of the catch member 230 adjacent to and in engagement with the locking feature 204, such as adjacent to the second portion 284 of the locking feature 204. In such examples, movement of the catch member 230 in the insertion direction may compress, bend, or otherwise move the locking feature 204 towards the second edge 330 of the aperture 326. More particularly, the catch member 230 may move the second portion 284 of the locking feature 204 towards the second edge 330 of the aperture 326 to bend or compress the first portion 282. Depending on the particular application, the locking feature 204 may be displaced, such as compressed, in the insertion direction and/or bent, moved, or deflected in a direction different than the insertion direction. In either case, the locking feature 204 may be biased to its original, neutral position once disengaged from the first snap fitting 202, as described below. Depending on the particular application, the locking feature 204 may return only partially to the neutral position, such as for example due to some plastic deformation of the locking feature 204 when displaced. In such examples, however, the locking feature 204 may still return sufficiently to engage a portion of the catch member 230 to limit disengagement of the first snap fitting 202.

Referring to FIG. 5, the catch member 230 may be moved in the insertion direction until the second portion 250 of the arm 234 disengages the ramp 340. Once the arm 234 disengages the ramp 340, the catch member 230 may bias to its first, neutral position to define the engaged configuration of the first snap fitting 202 and snap fit the first snap fitting 202 to the luggage case. More particularly, once the arm 234 disengages the ramp 340, the catch member 230 may move away from the tow handle tube 210, such as the first surface 240 of the catch member 230 moving towards the ramp 340, to snap fit the catch member 230 with a portion of the base wall 300 and connect the first snap fitting 202 to the second shell 152. To limit further movement of the first snap fitting 202 in the insertion direction, the abutment wall 268 of the first snap fitting 202 may engage the engagement structure 346 of the base wall 300. Additionally or alternatively, engagement of the abutment wall 268 with the engagement structure 346 may create a tight fit of the first snap fitting 202 between the partition wall 308 and the base wall 300 of the second shell 152 to limit undesired movement of the tow handle 178 relative to the second shell 152.

With continued reference to FIG. 5, once the first snap fitting 202 is connected to the second shell 152, the locking feature 204 may move back to its neutral position to limit disengagement of the first snap fitting 202. For instance, as the catch member 230 moves away from the tow handle tube 210 to engage the base wall 300 and/or the first edge 328 of the aperture 326, the catch member's engagement with the locking feature 204 is disengaged from the abutment face 256, thereby allowing the locking feature 204 to move within the gap G, such as underneath the catch member 230, between the catch member 230 and the tow handle tube 210. Once positioned within the gap G, the locking feature 204 may engage and resist displacement the catch member 230. As noted above, the locking feature 204 may allow some movement of the catch member 230, but not enough to allow disengagement of the catch member 230 from the first edge 328 and/or base wall 300. For instance, a small clearance may be defined between the catch member 230 and the locking feature 204 and/or between the locking feature 204 and the tow handle tube 210. In such examples, the catch member 230 (and locking feature 204) may move a small degree until the catch member 230, locking feature 204, and tow handle tube 210 form a solid column or strut to limit further deflection of the catch member 230.

Movement of the locking feature 204 to within the gap G may happen automatically, such as under bias created by compression or deflection of the first portion 282 of the locking feature 204. In this manner, the snap fit interlock 200 may be self-locking. Once the first snap fitting 202 and the locking feature 204 are interlocked together, the first snap fitting 202 may not be removed or disconnected without first disconnecting or removing the locking feature 204. In addition, the snap fit interlock 200 may help prevent the loosening of the engagement between the tow handle tube 210 and the second shell 152.

Figure 6:
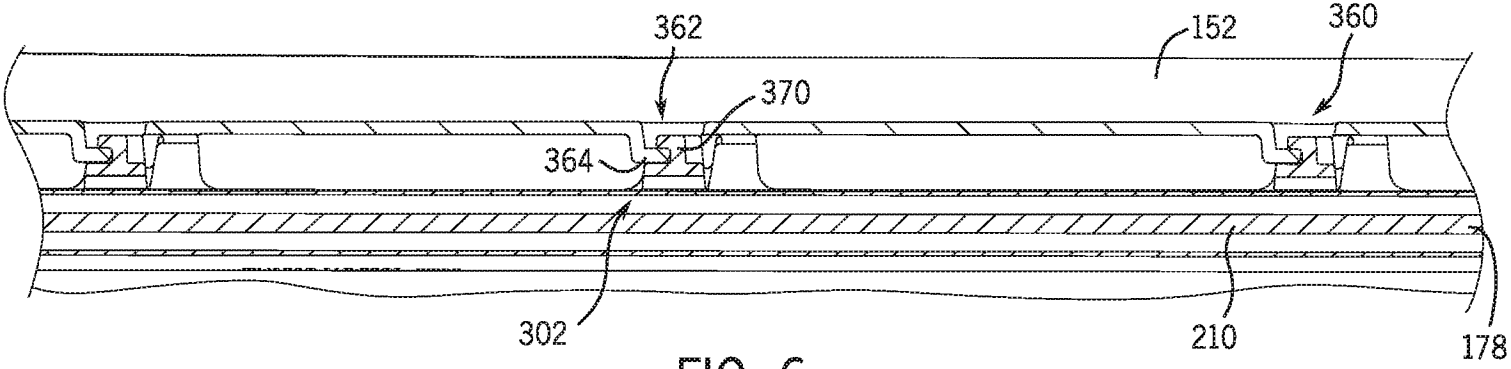
FIG. 6 is a cross-sectional view of an engagement between a tow handle tube and a luggage shell portion according to some examples of the present disclosure.

Referring to FIG. 6, the tow handle 178 may be additionally coupled to the second shell 152 via one or more additional connections 360 positioned along the length of the tow handle tube 210. In such examples, each connection 360 may be defined by engagement of corresponding retention features defined in or by the tow handle tube 210 and second shell 152. As one example of the connection 360, the second shell 152 may include a recess 362 defined in part by a ledge 364, the recess 362 in communication with the channel 302 defined on the rear panel 106 of the second shell 152. The tow handle tube 210 may include a bracket 370 configured to engage the ledge 364 when the first snap fitting 202 is engaged to couple the component to the luggage shells. The bracket 370 may be L-shaped to engage the ledge 364. In particular, the bracket 370 may be positioned within the recess 362 and adjacent to the ledge 364 when the first snap fitting 202 is positioned as shown in FIG. 3. As the first snap fitting 202 is moved in the insertion direction, such as shown sequentially in FIGS. 4 and 5, the bracket 370 may engage the ledge 364 in a non-interlocked fashion, as shown in FIG. 6. In such examples, the recess 362 may be sized to allow movement of the bracket 370 within the recess 362 as the first snap fitting 202 is moved to engage the first edge 328 of the aperture 326 and/or the base wall 300. In this manner, the tow handle tube 210 may be secured to the second shell 152 along its length. Though shown as including a plurality of additional connections 360, in some examples only a single additional connection 360 may be utilized, such as at a distal end of the tow handle tube 210.

Figure 7:
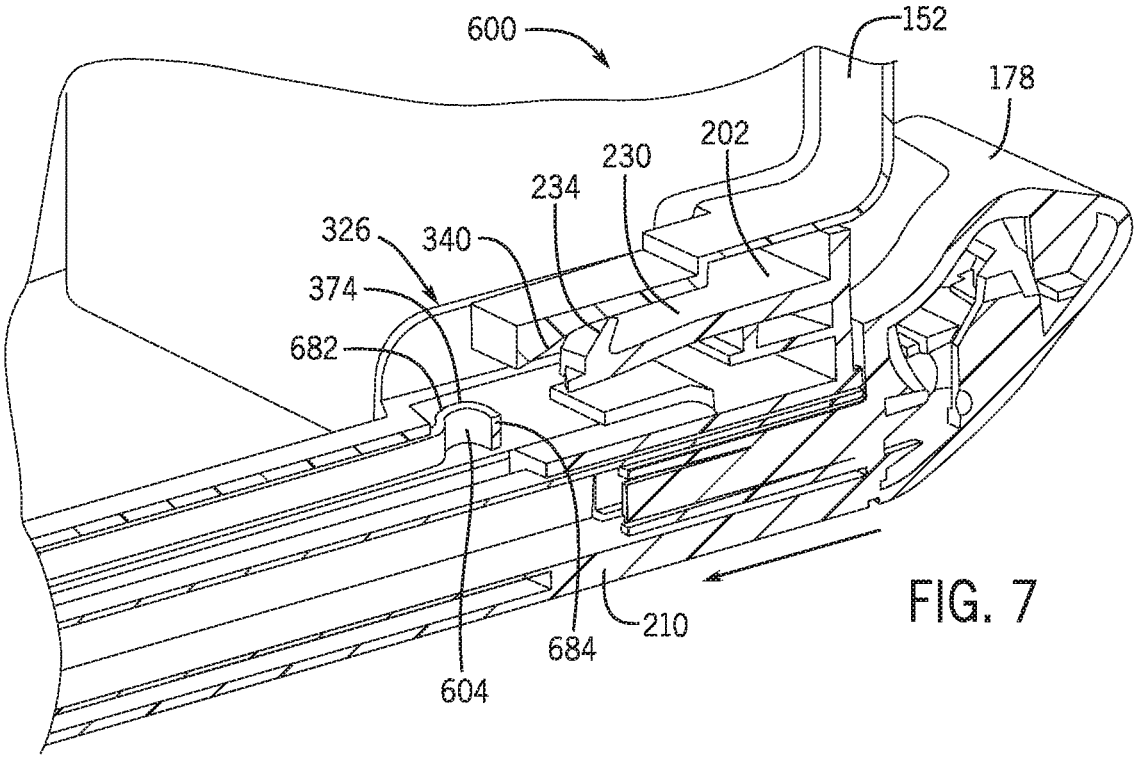
FIG. 7 is a cross-sectional view of an additional snap fit interlock of FIG. 2B in a first configuration according to some examples of the present disclosure.
Figure 8:
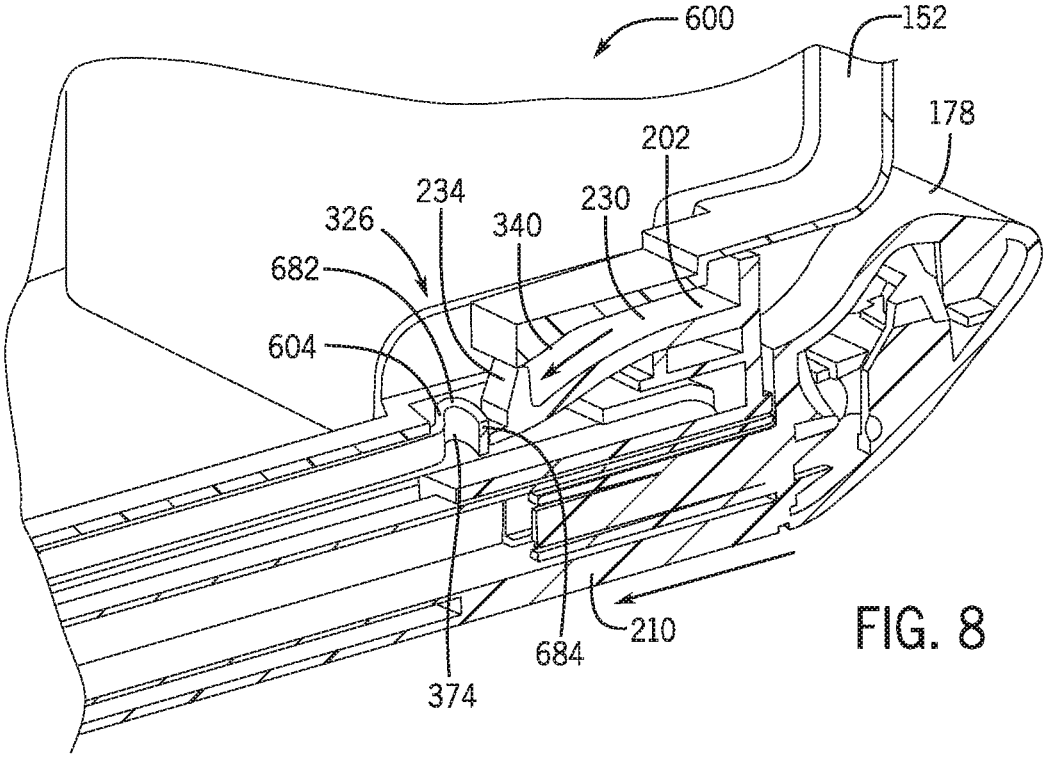
FIG. 8 is a cross-sectional view of the snap fit interlock of FIG. 2B in a second configuration according to some examples of the present disclosure.
Figure 9:
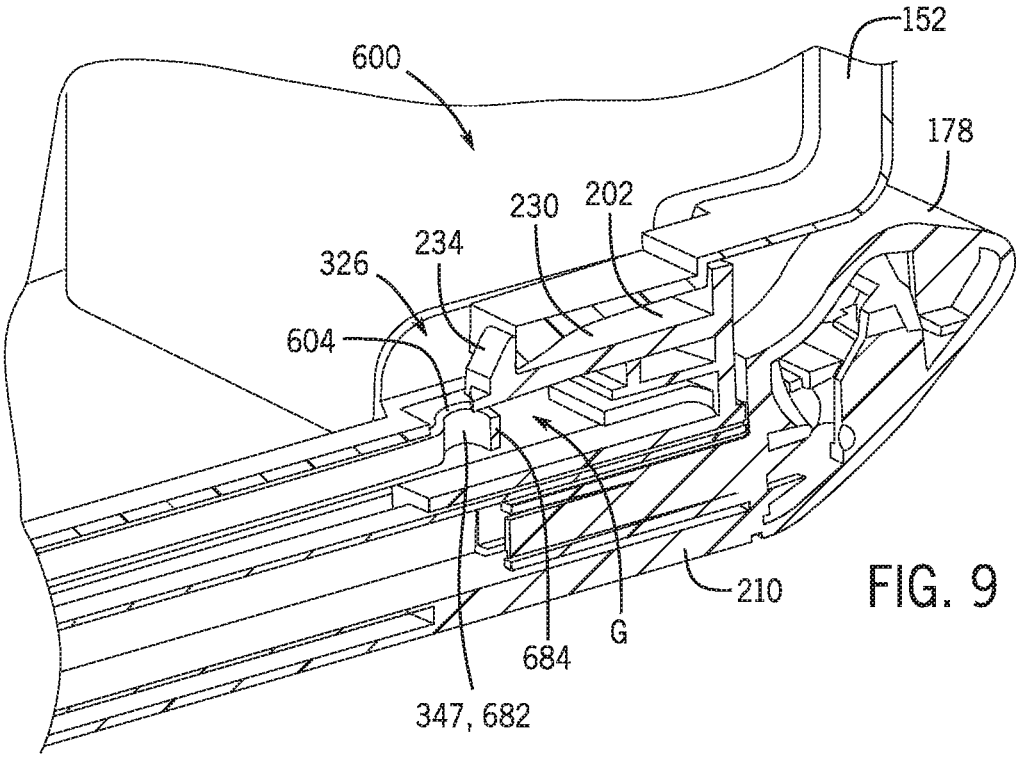
FIG. 9 is a cross-sectional view of the snap fit interlock of FIG. 2B in a third, engaged configuration according to some examples of the present disclosure.

FIGS. 2B and 7-9 are various views showing, in part, another example of the snap fit interlock used for coupling a component to the luggage shell. For ease of reference, the snap fit interlock of FIGS. 7-9 will be referenced by reference numeral "600." Except as otherwise described below, the snap fit interlock 600 illustrated in FIGS. 7-9 may be similar to the snap fit interlock 200 described above. As shown in FIGS. 7-9, the first portion 682 of the locking feature 604 may be defined by a biasing structure deflected in the direction of the motion of the snap fit interlock 600 during engagement. In one example, the locking feature 604 is an elongated member forming a loop 374. In one example, the loop 374 may be an elongated rim. As shown, the loop 374 may be continuous along its length, though it is contemplated that the loop 374 may be discontinuous along its length in some examples.

In such examples, the loop 374 may be deflected generally in its plane during engagement of the first snap fitting 202. In particular, the loop 374 may be deflected generally in its plane from a circular shape (see FIG. 7) to an oval shape (see FIG. 8) by being compressed by the catch member 230 of the first snap fitting 202 caused by movement of the catch member 230 in the insertion direction during engagement. When the catch member 230 biases upwardly as the arm 234 of the catch member 230 disengages the ramp 340, the loop 374 biases back to a more circular shape, such as its original circular shape or a less compressed shape, to be positioned near, and in some examples engage, the underside of the catch member 230 to limit the displacement or deflection of the catch member 230 towards the tow handle tube 210, which protects against the disengagement of the catch member 230. In this manner, the loop 374 may resist disengagement of the first snap fitting 202 in a direction other than in the plane defined by the loop 374. For example, the loop 374 may resist disengagement of the first snap fitting 202 in a direction orthogonal to the plane defined by the of the loop 374. In one example, the locking feature 604 may resist downward movement of the catch member 230. Should the catch member 230 be deflected downwardly a sufficient amount, the second portion 684 of the locking feature 604 may engage the catch member 230 and the tow handle tube 210 to form a solid or substantially solid stack or column and limit further deflection of the catch member 230 to limit disengagement of the first snap fitting 202. The interference caused by the locking feature 604 may occur before the catch member 230 is deflected enough to allow the catch member 230 to pass over the first edge 328 and disengage the component from the luggage shell.

Figure 10:
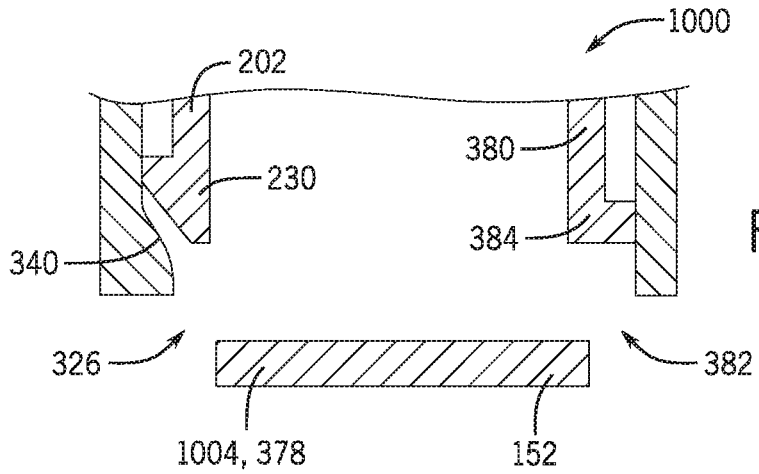
FIG. 10 is a cross-sectional view of an additional snap fit interlock in a first configuration according to some examples of the present disclosure.
Figure 11:
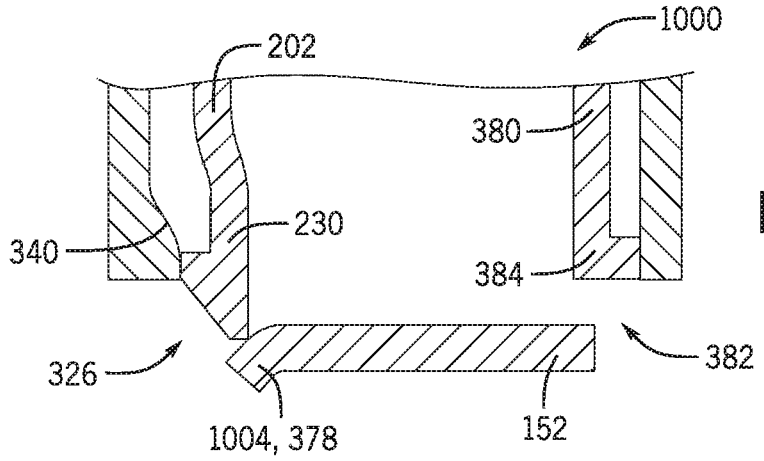
FIG. 11 is a cross-sectional view of the snap fit interlock of FIG. 10 in a second configuration according to some examples of the present disclosure.
Figure 12:
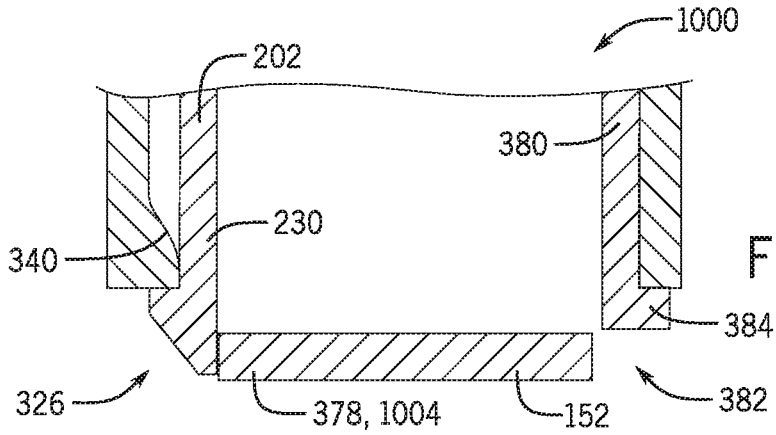
FIG. 12 is a cross-sectional view of the snap fit interlock of FIG. 10 in a third, engaged configuration according to some examples of the present disclosure.

FIGS. 10-12 are various views showing, in part, an additional snap fit interlock 1000. Except as otherwise described below, the snap fit interlock 1000 illustrated in FIGS. 10-12 may be similar to the snap fit interlocks 200, 600 described above. As shown in FIGS. 10-12, the locking feature 1004 may be formed as a nubbin or protrusion 378 extending from the second shell 152. In such examples, the protrusion 378 acts similar to the locking features 204, 604 described above, but may be much stiffer. The protrusion 378 may be cantilevered from a portion of the second shell 152 such that engagement of the first snap fitting 202 bends or deflects the protrusion 378 along its length. When the catch member 230 biases upwardly as the arm 234 of the catch 230 disengages the ramp 340, the protrusion 378 springs back to its original position, or substantially back to its original position, to engage the underside of the catch member 230 to limit the catch member 230 from deflecting downwardly towards the second shell 152 to disengage the catch member 230. Similar to the locking features 204, 604 described above, should the catch member 230 be deflected towards the second shell 152, the protrusion 378 will engage the catch member 230 to form a solid stack or column and limit further deflection.

In addition to the first snap fitting 202, the first component 218 may be secured to the luggage article 100 by a supplemental snap fitting 380 positioned opposite of the first snap fitting 202. In such examples, the supplemental snap fitting 380 may engage the edges defining a second aperture 382 positioned opposite of the aperture 326. As shown, the supplemental snap fitting 380 may be formed as or include a supplemental catch 384.

FIGS. 13-18 are various views showing, in part, an additional snap fit interlock 1400. Except as otherwise described below, the snap fit interlock 1400 illustrated in FIGS. 13-18 may be similar to the snap fit interlocks 200, 600, 1000 described above. As shown in FIGS. 13-18, the snap fit interlock 1400 may be used to connect a support member 170 (e.g., a spinner wheel assembly) to the housing 102, such as to the second shell 152. In such examples, the support member 170 may include a housing 386 defined by a base plate 388 and a sidewall 390 extending from at least a portion of the periphery of the base plate 388. As shown, a support structure 392 may extend upwardly from the base plate 388. The support structure 392 may extend from a central portion of the base plate 388. First and second shelves 394, 396 may extend laterally from the support structure 392 to define respective gaps G1, G2 between the shelves and the base plate 388. In such examples, the first snap fitting 202 may extend laterally from the support structure 392 between the first and second shelves 394, 396. In this manner, the first snap fitting 202 may be formed on a portion of the base plate 388 near one edge.

Figure 13:
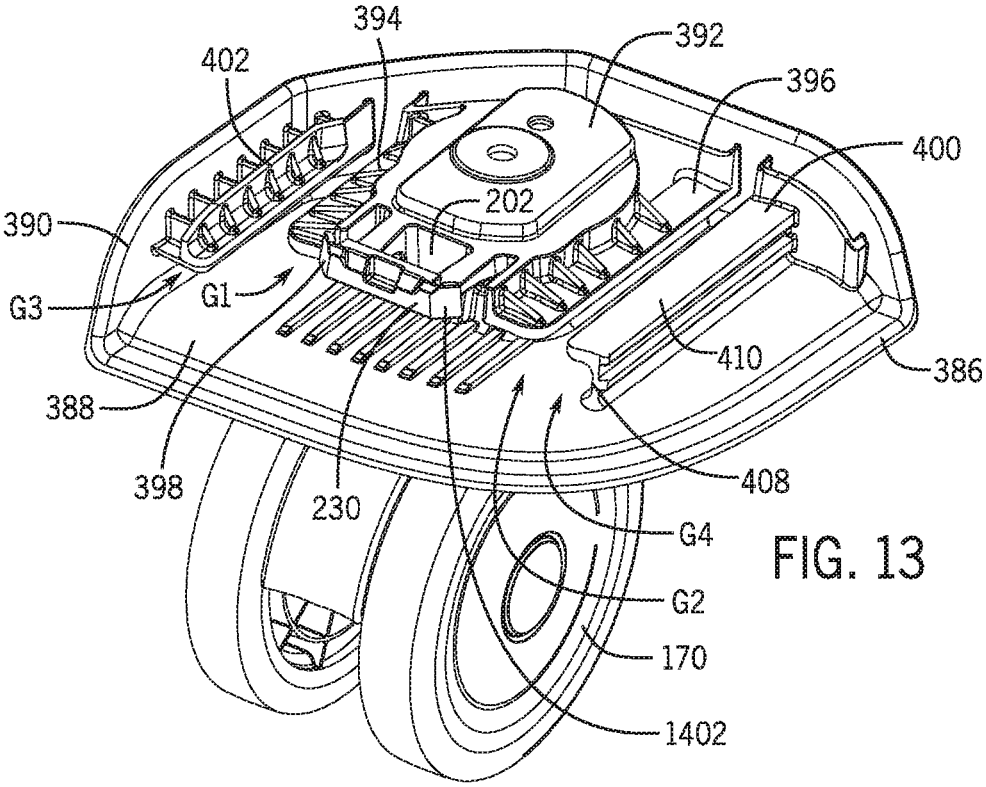
FIG. 13 is an isometric view of a wheel housing according to some examples of the present disclosure.
Figure 18:
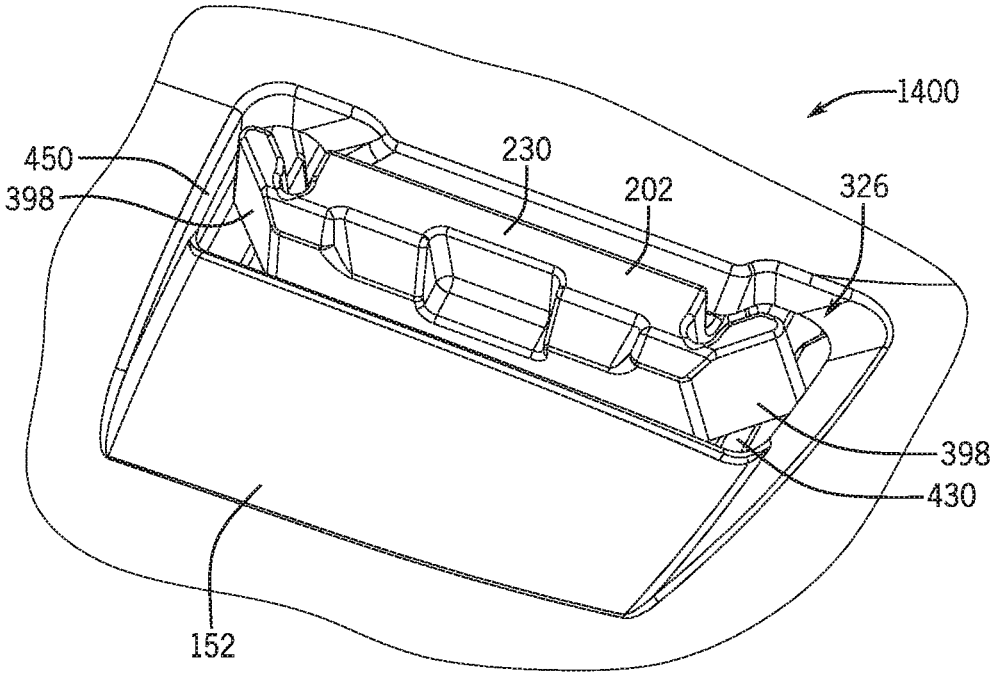
FIG. 18 is an enlarged detail view of the snap fit interlock of FIG. 15 in an engaged configuration.

Unlike the description above, the locking feature 1402 may be defined by or integral with the first snap fitting 202. For instance, as shown in FIGS. 13 and 18, the locking feature 1402 may be defined by one or more flexible wings 398, such as a pair of opposing wings 398, extending from lateral sides of the catch member 230. In particular, proximal ends of the wings 398 may be connected to lateral sides of the catch member 230. As described more fully below, the wings 398 may move between positions relative to the catch member 230. For instance, in the neutral position, distal ends of the wings 398 may be spaced away from the catch member 230. In the displaced position, distal ends of the wings 398 may be positioned towards the catch member 230. In such examples, the wings 398 may be biased to the neutral position.

In some examples, the housing 386 may include a bracket 400 extending from the base plate 388 on one side of the support structure 392, and a third shelf 402 extending from the sidewall 390 on an opposite side of the support structure 392. In such examples, the third shelf 402 may extend towards the first shelf 394 extending from the support structure 392. The third shelf 402 may be spaced away from the base plate 388 to define a third gap G3 between the base plate 388 and the third shelf 402. The bracket 400 may include a first wall 408 extending upwardly from the base plate 388, and a second wall 410 extending from a distal portion or edge of the first wall 408 and towards the second shelf 396 extending from the support structure 392. The first and second walls 408, 410 of the bracket 400 may define, in part, an L-shape to define a fourth gap G4 between the base plate 388 and the second wall 410.

Figure 14:
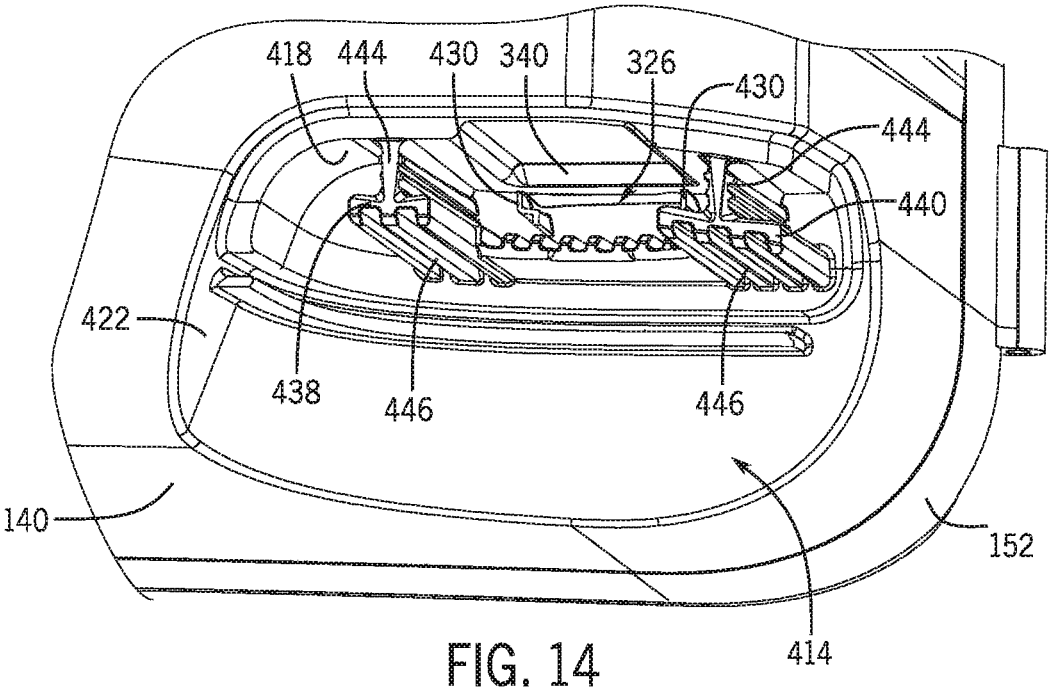
FIG. 14 is an enlarged detail view of a wheel well of the luggage shell portion of FIG. 2 according to some examples of the present disclosure.
Figure 15:
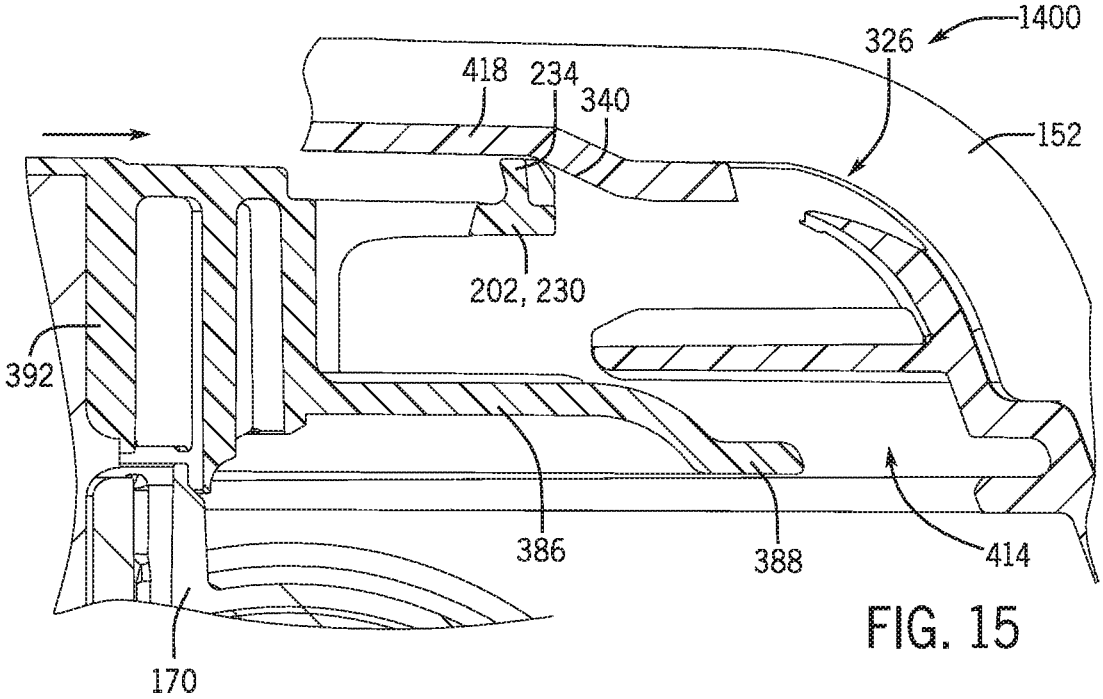
FIG. 15 is a cross-sectional view of an additional snap fit interlock in a first configuration according to some examples of the present disclosure.
Figure 16:
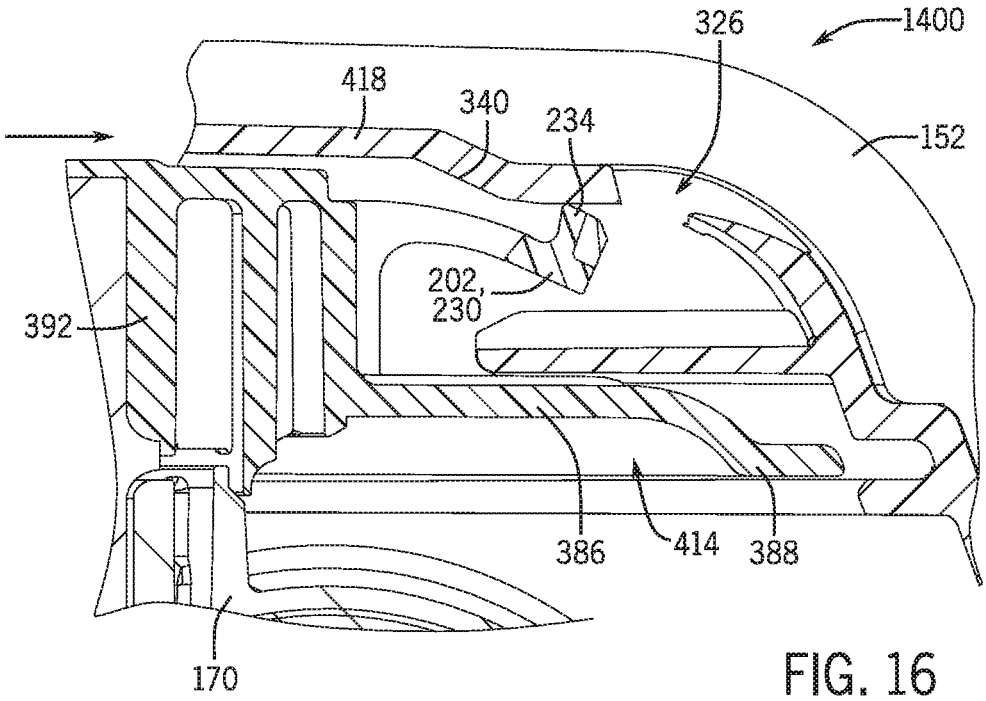
FIG. 16 is a cross-sectional view of the snap fit interlock of FIG. 15 in a second configuration according to some examples of the present disclosure.
Figure 17:
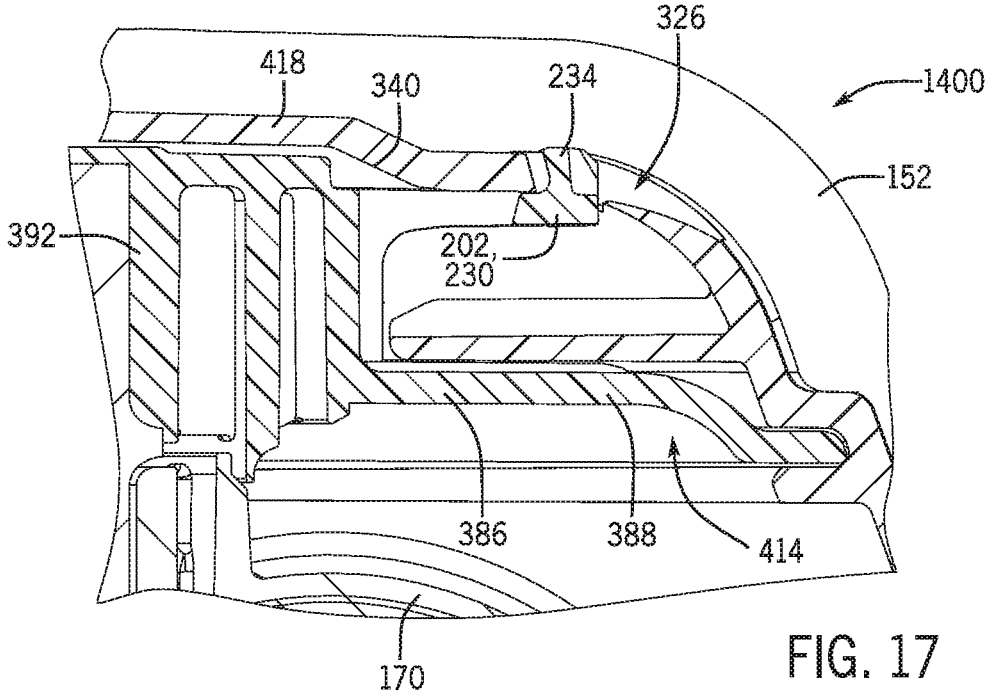
FIG. 17 is a cross-sectional view of the snap fit interlock of FIG. 15 in a third, engaged configuration according to some examples of the present disclosure.

Referring to FIG. 14, the second shell 152 may be include features configured to interlock with the first snap fitting 202 and the features of the housing 386. For instance, a recessed portion 414 may be defined near the corner regions 140 of the second shell 152 to receive the housing 386. The recessed portion 414, which may be referred to as a wheel well, may be defined by a top wall 418 and a side wall 422 defining a cavity at the corner regions 140. In such examples, the ramp 340 and aperture 326 may be defined in the top wall 418, with the ramp 340 defined in the top wall 418 adjacent to the aperture 326. One or more guides 430 may extend from the top wall 418 for engagement with a respective wing 398. For example, as shown in FIG. 14, a pair of guides 430 may extend from the top wall 418 on opposing sides of the aperture 326. The guides 430 may be angled towards the aperture 326. The guides 430 may be positioned on opposing sides of the ramp 340. In addition, first and second supports 438, 440 may extend downwardly from the top wall 418. As explained below, the first and second supports 438, 440 may be arranged to engage the bracket 400 and the first, second, and third shelves 394, 396, 402 of the housing 386 to connect the housing 386 to the second shell 152. For instance, each of the first and second supports 438, 440 may include a T-shape with a first portion 444 extending from the top wall 418, and a second portion 446 extending from a distal region of the first portion 444, such as perpendicularly from the first portion 444.

To connect the housing 386 of the support member 170 to the second shell 152, the housing 386 may be positioned adjacent to the recessed portion 414 such that the first and second supports 438, 440 of the second shell 152 are aligned with the gaps defined by the first shelf 394, second shelf 396, third shelf 402, and bracket 400 of the housing 386. In particular, the housing 386 may be positioned such that the second portion 446 of the first support 438 is positioned, at least partially, within the second and fourth gaps G2, G4 defined by the second shelf 396 and bracket 400, respectively, and the first portion 444 of the first support 438 positioned between the second shelf 396 and bracket 400. In like manner, the second portion 446 of the second support 440 may be positioned, at least partially, within the first and third gaps G1, G3 defined by the first and third shelves 394, 402, respectively, and the first portion 444 of the second support 440 positioned between the first and second shelves 394, 396. In this position, the catch member 230 may be positioned against a portion of the top wall 418.

Once positioned, the housing 386 may be slid toward the side wall 422 until the first snap fitting 202 is connected. In particular, the housing 386 may be slid toward the side wall 422 until the arm 234 engages the ramp 340, at which point the catch member 230 may be deflected toward the base plate 388 of the housing 386 in a similar manner as described above with respect to the snap fit interlock 200. At or about the same time the catch member 230 is deflected downwardly by the ramp 340, the wings 398 may be laterally collapsed toward the catch member 230 by the guides 430 positioned adjacent to the aperture 326. For instance, the guides 430 may flex the wings 398 inwardly toward the catch member 230 as the first snap fitting 202 is moved in the insertion direction. The wings 398 may be displaced sufficiently to allow the wings 398 to pass through and clear lateral edges 450 of the aperture 326.

The housing 386 and first snap fitting 202 may be slid toward the side wall 422 in the insertion direction until the catch member 230 disengages the ramp 340, at which point the catch member 230 and wings 398 pass through the aperture 326. Once the wings 398 pass through the aperture 326, the wings 398 may extend outwardly to engage the lateral edges 450 of the aperture 326 (see FIG. 18). For instance, once the wings 398 are extended, the wings 398 may be wider than a lateral dimension of the aperture 326 defined by the lateral edges 450. In such examples, at least a portion of the wings 398 may engage the lateral edges 450 and limit movement of the catch member 230 to disengage from the second shell 152.

In some examples, the wings 398 may engage other portions of the second shell 152 other than the lateral edges 450 of the aperture 326 to limit movement of the catch member 230 to disengage from the second shell 152. For example, the wings 398 may engage portions of the guides 430 as the catch member 230 and wings 398 move upwardly to the engaged configuration. In such examples, the wings 398 may not pass completely through the aperture 326 to engage the guides 430.

Depending on the particular application, the wings 398 may pop outwardly into place before or after the arm 234 is fully seated in position within the aperture 326. For instance, the wings 398 may pass through the aperture 326 first, moving laterally outwardly to engage sidewalls of the aperture 326 before the catch member 230 engages the first edge 328 of the aperture 326. In some examples, the wings 398 may pop outwardly into place at substantially the same moment the arm 234 is fully seated within the aperture 326. Once the first snap fitting 202 is snap fit to the top wall 418

In such examples, the wings 398 may limit disengagement of the first snap fitting 202 once engaged. For instance, because the wings 398 catch lateral edges 450 of the aperture 326 once the first snap fitting 202 is connected, removal of the first snap fitting 202 from the aperture 326 may be limited absent disengagement of the wings 398 from the lateral edges 450 of the aperture 326. In particular, the first snap fitting 202 may not be removable from the aperture 326 without first compressing the wings 398 towards the catch member 230 such that the collapsed wings 398 fit through the aperture 326.

The luggage article 100 may be formed from a variety of materials and means. For example, the housing 102, among others, may be formed from a thermoplastic material (self-reinforced or fiber reinforced), ABS, polycarbonate, polypropylene, polystyrene, PVC, polyamide, and/or PTFE, among others. In some examples, portions of the luggage article 100 may be extruded from aluminum or other similar metal. In addition, the housing 102 may be formed from fiber reinforced epoxy, resin, or other similar material. The luggage article 100 may be formed or molded in any suitable manner, such as by plug molding, blow molding, injection molding, extrusion, casting, or the like. As noted above, the luggage article 100 may be formed from soft side material and/or hard side material. Exemplary materials are noted above.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article connected to a luggage article component via an integrated snap fit interlock, the luggage article comprising a luggage shell and the snap fit interlock comprising:

a snap fitting positionable in an engaged configuration to connect the luggage article component to the luggage shell; and a locking feature automatically limiting the disengagement of the snap fitting from the engaged configuration, wherein:

the snap fitting comprises a portion configured to bias the locking feature to a displaced or compressed configuration during assembly;

the snap fitting is configured to disengage the locking feature when the snap fitting is in the engaged configuration to allow movement of the locking feature to a neutral or uncompressed configuration;

the locking feature includes a portion positioned between the snap fitting and the luggage article component to limit disconnection of the snap fitting through interference, when the snap fitting is in the engaged configuration and the locking feature is in the neutral or uncompressed configuration, and the luggage article component is a tow handle, a carry handle, or a wheel housing.

2. The luggage article of claim 1, wherein the locking feature limits movement of at least a portion of the snap fitting to limit disengagement of the snap fitting.

3. The luggage article of claim 1, wherein the snap fitting engages and moves the locking feature as the snap fitting is moved in an insertion direction during attachment of the luggage article component to the luggage shell.

4. The luggage article of claim 3, wherein:

the snap fitting defines a first and a second position as the snap fitting is moved in an insertion direction; and the snap fitting engages and moves the locking feature only when the snap fitting is in the second position.

5. The luggage article of claim 4, wherein the locking feature disengages from the snap fitting when the snap fitting moves to the first position.

6. The luggage article of claim 4, wherein the first and second positions of the snap fitting are defined at a first level of displacement and a second level of displacement, respectively.

7. The luggage article of claim 6, wherein the luggage shell includes a ramp to displace the snap fitting from the first level of displacement to the second level of displacement.

8. The luggage article of claim 6, wherein the snap fitting engages and moves the locking feature only when the snap fitting is at the second level of displacement.

9. The luggage article of claim 1, wherein the locking feature creates a stacked arrangement between the luggage article component, locking feature, and snap fitting to limit disengagement of the snap fitting.

10. The luggage article of claim 1, wherein the locking feature allows movement of at least a portion of the snap fitting a first distance less than a distance required to disengage the snap fitting from the luggage shell.

11. The luggage article of claim 1, wherein the locking feature includes a portion that resists disengagement of the snap fitting in a direction along its length.

12. The luggage article of claim 1, wherein the locking feature includes:

a loop structure deflecting at least partially in a plane during engagement of the snap fitting to the luggage shell.

13. The luggage article of claim 1, wherein the snap fitting comprises a catch having a resilient main body and an arm connected to a distal end of the main body, the main body and arm defining an L-shape.

14. The luggage article of claim 1, wherein the locking feature includes at least one wing extending from a lateral side of the snap fitting, the at least one wing engaging a lateral edge of an aperture defined in the luggage shell to limit removal of the snap fitting from the aperture once the snap fitting is engaged.

15. The luggage article of claim 1, wherein the locking feature includes a protrusion that deflects along a length of the protrusion during engagement of the snap fitting to the luggage shell.

* * * * *